US006286588B1

(12) United States Patent
Uehara

(10) Patent No.: US 6,286,588 B1
(45) Date of Patent: Sep. 11, 2001

(54) EVAPORATOR

(76) Inventor: Haruo Uehara, 1544-119, Ooaza-Kinryu, Kinryu-Machi, Saga-Shi, Saga-Ken (JP)

( * ) Notice: Subject to any disclaimer, the term of this patent is extended or adjusted under 35 U.S.C. 154(b) by 0 days.

(21) Appl. No.: 09/550,292

(22) Filed: Apr. 14, 2000

(30) Foreign Application Priority Data

Apr. 28, 1999 (JP) ..... 11-122777

(51) Int. Cl.[7] ..... F28F 13/00
(52) U.S. Cl. ..... 165/146; 165/166; 165/167
(58) Field of Search ..... 165/165, 166, 165/110, 170, 146, 167

(56) References Cited

U.S. PATENT DOCUMENTS 3,256,704 * 6/1966 Becker ..... 165/166
3,282,334 * 11/1966 Stahlheber ..... 165/166
3,587,730 * 6/1971 Milton ..... 165/166
4,099,928 * 7/1978 Norback ..... 165/166
4,182,411 * 1/1980 Sumitomo et al. ..... 166/110
4,330,308 * 5/1982 Grenier et al. ..... 165/140
5,035,284 * 7/1991 Oya et al. ..... 165/146
5,287,918 * 2/1994 Banks et al. ..... 165/166
5,333,683 * 8/1994 Arriulou et al. ..... 165/110
5,573,060 * 11/1996 Adderley et al. ..... 165/166
5,915,469 * 6/1999 Abramozon et al. ..... 165/146

* cited by examiner

*Primary Examiner*—Ira S. Lazarus
*Assistant Examiner*—Terrell McKinnon
(74) *Attorney, Agent, or Firm*—Rader, Fishman & Grauer, PLLC

(57) ABSTRACT

Local heat transferring zones are provided on a heat transferring face. The zones have prescribed patterns of irregularity, which are different from each other. Resistance corresponding to the flowing velocity of the high temperature fluid is imparted to the high temperature fluid by the patterns of irregularity in the zones. It is possible to distribute uniformly the high temperature fluid to the zones to cause it to flow over the entirety of the heat transferring face so as to obtain a uniform flow rate of the high temperature fluid on the zones, improve the contact efficiency of the high temperature fluid with the heat transferring face and improve the heat transfer efficiency of the high temperature fluid to the low temperature fluid through the heat transferring face, unlike the conventional case that the high temperature fluid does not flow in a uniform state on the heat transferring face due to the biased position for the supply of the high temperature fluid.

6 Claims, 5 Drawing Sheets

EVAPORATOR

BACKGROUND OF THE INVENTION

1. Field of the Invention

The present invention relates to an evaporator for evaporating a low temperature fluid through a heat transfer from a high temperature fluid to the low temperature fluid, and especially to an evaporator having a high evaporation efficiency.

2. Description of the Related Art

In general, an evaporator is used in a plant of electric generation by temperature difference, steam power, chemistry, food engineering and the like, a refrigerator and a heat pump. Such an evaporator can make heat exchange between high temperature fluid and low temperature fluid for the purposes of making change of phase of the low temperature fluid from a liquid phase to a gaseous phase. The conventional evaporator may be classified into a shell and tube evaporator, a plate type evaporator, a spiral type evaporator and the like. The plate type evaporator is generally used as an evaporator for evaporating the low temperature fluid through the heat of the high temperature fluid for example in a plant of electric generation by temperature difference. An example of the conventional evaporator is shown in FIGS. 4 and 5. FIG. 4 is an exploded perspective view illustrating essential components of the conventional evaporator. FIG. 5 is a schematic descriptive view of the conventional evaporator in an assembled condition.

The conventional evaporator 100 as shown in FIGS. 4 and 5 is provided with plural pairs of heat exchange plates 101, 102. In each pair, the heat exchange plate 101 is placed on the other heat exchange plate 102. Upper and lower guide rods 105, 106 held between a stationary frame 103 and a support rod 104 support the plural pairs of these heat exchange plates 101, 102. The plural pairs of the heat exchange plates 101, 102 are firmly held between the stationary frame 103 and a movable frame 107 that is mounted on the guide rods 105, 106. Two heat exchange passages A, B are formed on the opposite surfaces of each of the heat exchange plates 101, 102. A high temperature fluid 108 flows in the heat exchange passage A and a low temperature fluid 109 flows in the other heat exchange passage B so as to make heat exchange.

The above-mentioned heat exchange plates 101, 102 having a prescribed shape and a surface condition can be obtained by press-forming a plate-shaped material. Openings "a", "b", "c" and "d" through which the high temperature fluid 108 or the low temperature fluid 109 can pass, are formed at four corners of each of the heat exchange plates 101, 102. Packing members 111, 112 are placed on the surfaces of the heat exchange plates 101, 102, respectively, so as to prevent the heat exchanger fluid 108 and the working fluid 109 from flowing in a mixing condition. The heat exchange plates 101, 102 have the same shape, but the heat exchange plates 102 is placed upside down relative to the normal placement of the heat exchange plate 101.

The heat exchange plates 101, 102 serving as the heat transferring face has a pattern of irregularity (not shown) formed thereon in order to increase the heat transferring area and facilitate the heat transfer from the high temperature fluid 108 to the heat transferring face as well as the heat transfer from the heat transferring face to the low temperature fluid 109.

However, due to the above-described structure of the conventional evaporator, the inlet portion through which the high temperature fluid 108 flows toward a zone between the heat exchange plates 101, 102 serving as the heat transfer face is small relative to the size of the plates 101, 102 so that the high temperature fluid 108, which is supplied through the inlet portion, has a velocity distribution in the width direction of the plates 101, 102. As a result, a uniform flowing condition of the supplied high temperature fluid 108 over the entirety of the heat transferring face cannot be obtained, leading to a non-uniform flowing distribution. Accordingly, a uniform contact condition of the high temperature fluid 108 with the heat transferring face over its entirety cannot also be obtained, causing a problem of low heat transfer efficiency of the high temperature fluid to the heat transferring face although the heat transferring face is relatively large.

SUMMARY OF THE INVENTION

An object of the present invention, which was made to solve the above-described problems is therefore to provide an evaporator in which a heat transferring face has a shape by which a high temperature fluid can come into contact with the entirety of the heat transferring face in a uniform state, and a stable and sufficient heat exchange can be made over the entirety of the heat transferring face to facilitate evaporation of the low temperature fluid, thus improving the heat exchange efficiency.

In order to attain the aforementioned object, an evaporator of the present invention comprises:

at least one heat transferring face formed of a plate-shaped material, change of phase of a low temperature fluid from a liquid phase to a gaseous phase being made by causing a high temperature fluid and the low temperature fluid to flow on opposite surface sides of said heat transferring face, respectively, so that flowing directions of said high and low temperature fluids are perpendicular to each other, to make a heat exchange, wherein:

said heat transferring face comprises a plurality of local heat transferring zones, which are arranged in the flowing direction of said low temperature fluid, said local heat transferring zones having prescribed patterns of irregularity, which are different from each other, and each of said prescribed patterns of irregularity being formed by opposite surfaces of said heat transferring face, which have a common concavo-convex shape to each other and an inverse relationship to each other in concavo-convexities that appear on the opposite surfaces of said heat transferring face, which locate on the high and low temperature fluids sides, respectively; and the concavo-convexity of the pattern of irregularity in each of said local heat transferring zones has a shape, which permits to impart a large resistance force to said high temperature fluid in a place where the high temperature fluid has a high flowing velocity and a small resistance force thereto in another place where the high temperature fluid has a low flowing velocity, and said high temperature fluid can flow along the heat transferring face in a uniform distribution state in each of the local heat transferring zones.

According to the present invention, by providing the local heat transferring zones on the heat transferring face for the heat exchange, forming the prescribed patterns of irregularity, which are different from each other in the respective local heat transferring zones and imparting resistance corresponding to the flowing velocity of the high temperature fluid to the supplied high temperature fluid by the patterns of irregularity in the respective local heat transferring zones, it is possible to distribute uniformly the supplied high temperature fluid to each of the local heat transferring zones of the heat transferring face. According to the present invention, by providing the local heat transferring zones on the heat transferring face for the heat exchange, forming the prescribed patterns of irregularity, which are different from each other in the respective local heat transferring zones and imparting resistance corresponding to the flowing velocity of the high temperature fluid to the supplied high temperature fluid by the patterns of irregularity in the respective local heat transferring zones, it is possible to uniformly distribute the supplied high temperature fluid to each of the local heat transferring zones of the heat transferring face.

There may be adopted, as the occasion demands, a structure that the pattern of irregularity of one of the local heat transferring zones of said heat transferring face, in which the high temperature fluid has a maximum flowing velocity, is formed in a shape of elongated projections or grooves that extend in the flowing direction of the low temperature fluid and is formed in a concavo-convex shape having a wavy cross section having a prescribed pitch, which extends in the flowing direction of the high temperature fluid; and the pattern of irregularity of another of the local heat transferring zones, which is adjacent to said one of them, is formed in a shape of elongated projections or grooves that extend in a oblique direction to the flowing direction of the low temperature fluid by a prescribed angle and is formed in a concavo-convex shape having a wavy cross section having a prescribed pitch, which extend in a perpendicular direction to said oblique direction. According to the present invention, it is possible to cause the high temperature fluid to flow more smoothly in the local heat transferring zone, which is adjacent to the other local heat transferring zone, in which the high temperature fluid has the maximum flowing velocity, rather than the above-mentioned other local heat transferring zone to obtain a uniform flow rate of the high temperature fluid over the entirety of the heat transferring face, by forming the pattern of irregularity of one of the local heat transferring zones, in which the high temperature fluid has the maximum flowing velocity, in a concavo-convex shape, which extends in the flowing direction of the high temperature fluid, so as to increase resistance to the flow of the high temperature fluid, on the one hand, and forming the pattern of irregularity of the other local heat transferring zone, which is adjacent to the above-mentioned one zone, in a concavo-convex shape, which extends in the oblique direction to the flowing direction of the low temperature fluid, so as to decrease resistance to the flow of the high temperature fluid.

Consequently, it is possible to improve the contact efficiency of the entire heat transferring face with the high temperature fluid, improve the heat transfer efficiency of the high temperature fluid to the heat transferring face and facilitate the evaporation efficiency of the low temperature fluid.

There may be adopted, as the occasion demands, a structure that the pattern of irregularity of said heat transferring face, which is formed in the concavo-convex shape having the wavy cross section, is obtained by arranging the elongated projections or the grooves having a size by which a maximum coefficient of heat transfer from the high temperature fluid can be provided, on the one hand, and the elongated projections or the grooves having a size by which a maximum coefficient of heat transfer relative to the low temperature fluid can be provided, on the other hand, alone or in combination by a prescribed pitch. According to the present invention, it is possible to obtain the maximum coefficient of heat transfer from the high temperature fluid to the low temperature fluid so as to facilitate the evaporation efficiency thereof, by forming the concavo-convex shape in a prescribed region of the heat transferring face, which shape is obtained by arranging the elongated projections or the grooves having a size by which the maximum coefficient of heat transfer from the high temperature fluid can be provided, on the one hand, and the elongated projections or the grooves having a size by which the maximum coefficient of heat transfer relative to the low temperature fluid can be provided, on the other hand, alone or in combination by a prescribed pitch, and by maintaining an improved condition on the heat transfer property of the respective fluids and the heat transferring face.

There may be adopted, as the occasion demands, a structure that the pattern of irregularity of one of the local heat transferring zones of said heat transferring face, which one locates nearest to an inlet of the low temperature fluid, is formed in a shape of elongated projections or grooves that extend in the flowing direction of the low temperature fluid and is formed in a concavo-convex shape having a wavy cross section having a prescribed pitch, which extends in the flowing direction of the high temperature fluid. According to the present invention, it is possible to ensure the large heat transferring area utilizing the convavo-convex shape and facilitate the improved contact of the high temperature fluid with the local heat transferring zone of the low temperature fluid flowing side of the heat transferring face to cause a proper heat transfer by forming the pattern of irregularity of the local heat transferring zone locating nearest to the inlet of the low temperature fluid into a prescribed shape, a longitudinal direction of which is identical to the flowing direction of the low temperature fluid so that the low temperature fluid can easily flow on the heat transferring face. In addition, it is possible to reduce the flow resistance of the low temperature fluid to cause the low temperature fluid to flow smoothly between the heat transferring faces for contact with the heat transferring face. As a result, the improved heat transfer from the heat transferring face to the low temperature fluid can be obtained, thus causing efficient boiling and evaporation of the low temperature fluid.

There may be adopted, as the occasion demands, a structure that said heat transferring face is porous in a prescribed region, which locates in a middle portion of its surface of the low temperature fluid side in the flowing direction of the high temperature fluid, in one of the local heat transferring zones, in which the high temperature fluid has a maximum flowing velocity. According to the present invention, it is possible to make bubbles as fine as possible, which are generated in the low temperature fluid by heat, and discharge smoothly them upward by forming the porous portion on the heat transferring face, which locates in the middle portion of its surface of the low temperature fluid side, to increase the number of bubble generation cores in the low temperature fluid, which comes into contact with the heat transferring face to be heated, and to facilitate removal of the bubble generation cores, which have grown to a prescribed size, from the heat transferring face. As a result, it is possible to ensure the large contact area of the low temperature fluid in the liquid phase with the heat transferring face, thus causing efficiently evaporation of the low temperature fluid.

There may be adopted, as the occasion demands, a structure that said heat transferring face is formed of the plate-shaped material having a rectangular or square shape, sides of which coincide with the flowing directions of the high and low temperature fluids, respectively; and the pattern of irregularity of each of the local heat transferring zones of said heat transferring face is symmetrical relative to a bisector of the heat transferring face, which is in parallel with the flowing direction of the low temperature fluid. According to the present invention, it is possible to use the heat transferring face in the normal state as well as in the inside-out turning state so that the heat transferring faces having the same shape can form the opposing members, thus reducing the cost of the evaporator itself, by making the pattern of irregularity of each of the local heat transferring zones of the heat transferring face symmetrical relative to the bisector of the heat transferring face so as to permit to reverse the flowing direction of the high temperature fluid without causing any change in the heat transfer condition.

DETAILED DESCRIPTION OF THE PREFERRED EMBODIMENTS

Figure 1:
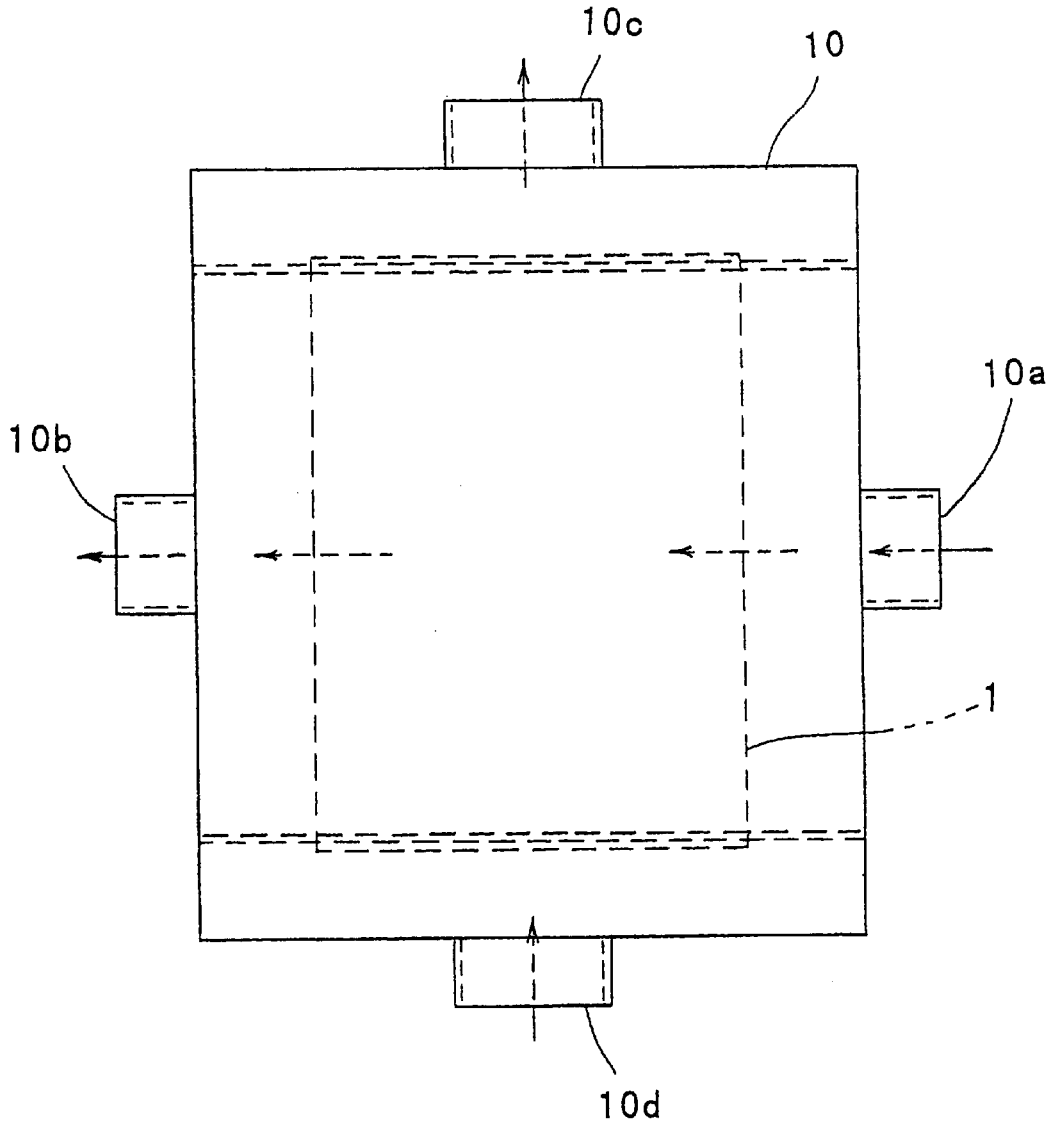
FIG. 1 is a side view illustrating an evaporator of the embodiment of the present invention in its installation state.

Now, an embodiment of an evaporator of the present invention will be described in detail below with reference to FIGS. 1 to 3. In the evaporator of the embodiment of the present invention, sea water is used as the high temperature fluid and ammonia or a mixture of ammonia and water is used as the low temperature fluid. FIG. 1 is a side view illustrating an evaporator of the embodiment of the present invention in its installation state, FIG. 2 is a schematic constructional view of the heat transferring face of the evaporator of the embodiment of the present invention and FIG. 3 is a perspective view of the essential part of the heat transferring face of the evaporator of the embodiment of the present invention, which has a sectioned portion.

Figure 2:
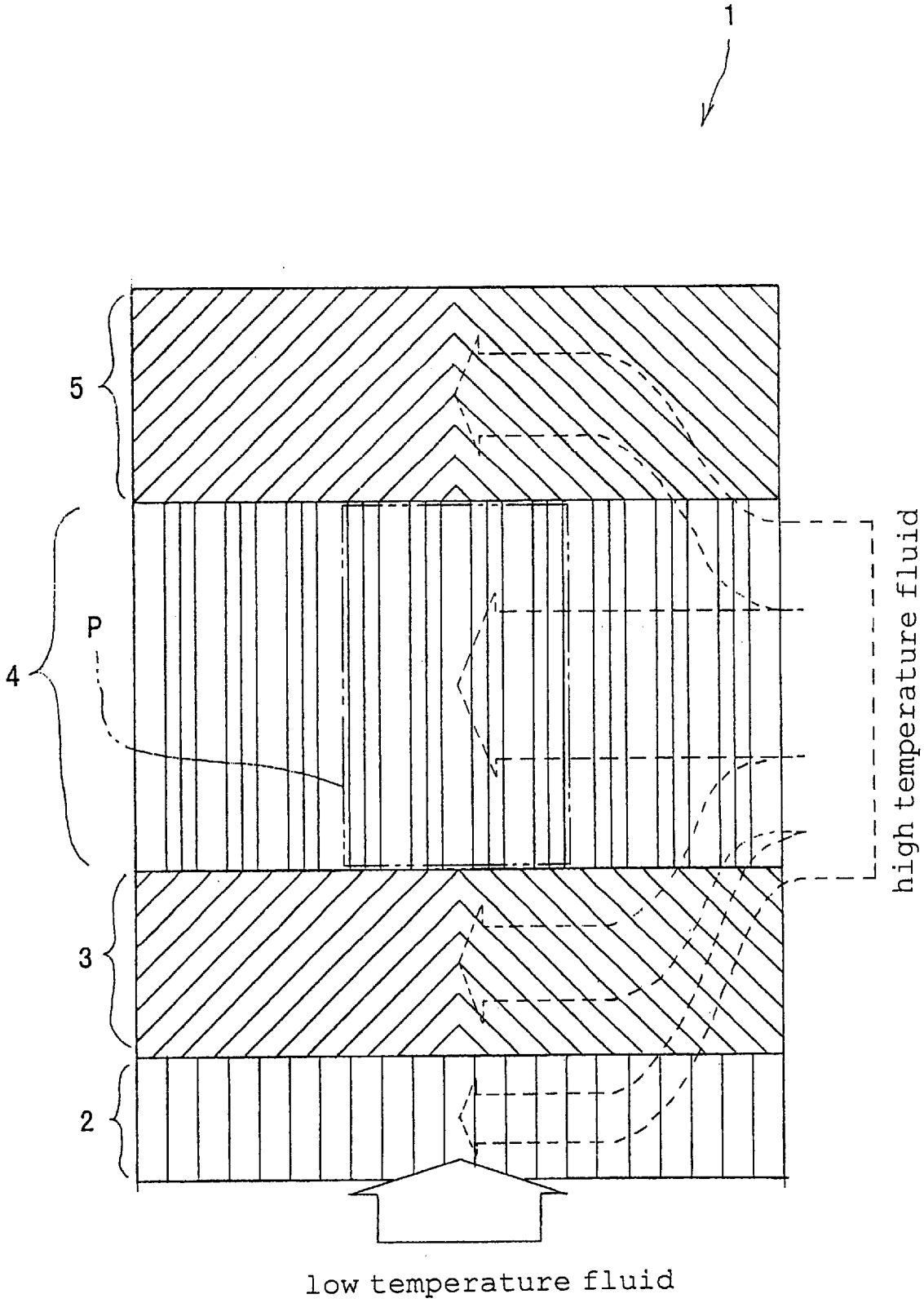
FIG. 2 is a schematic constructional view of the heat transferring face of the evaporator of the embodiment of the present invention.
Figure 3:
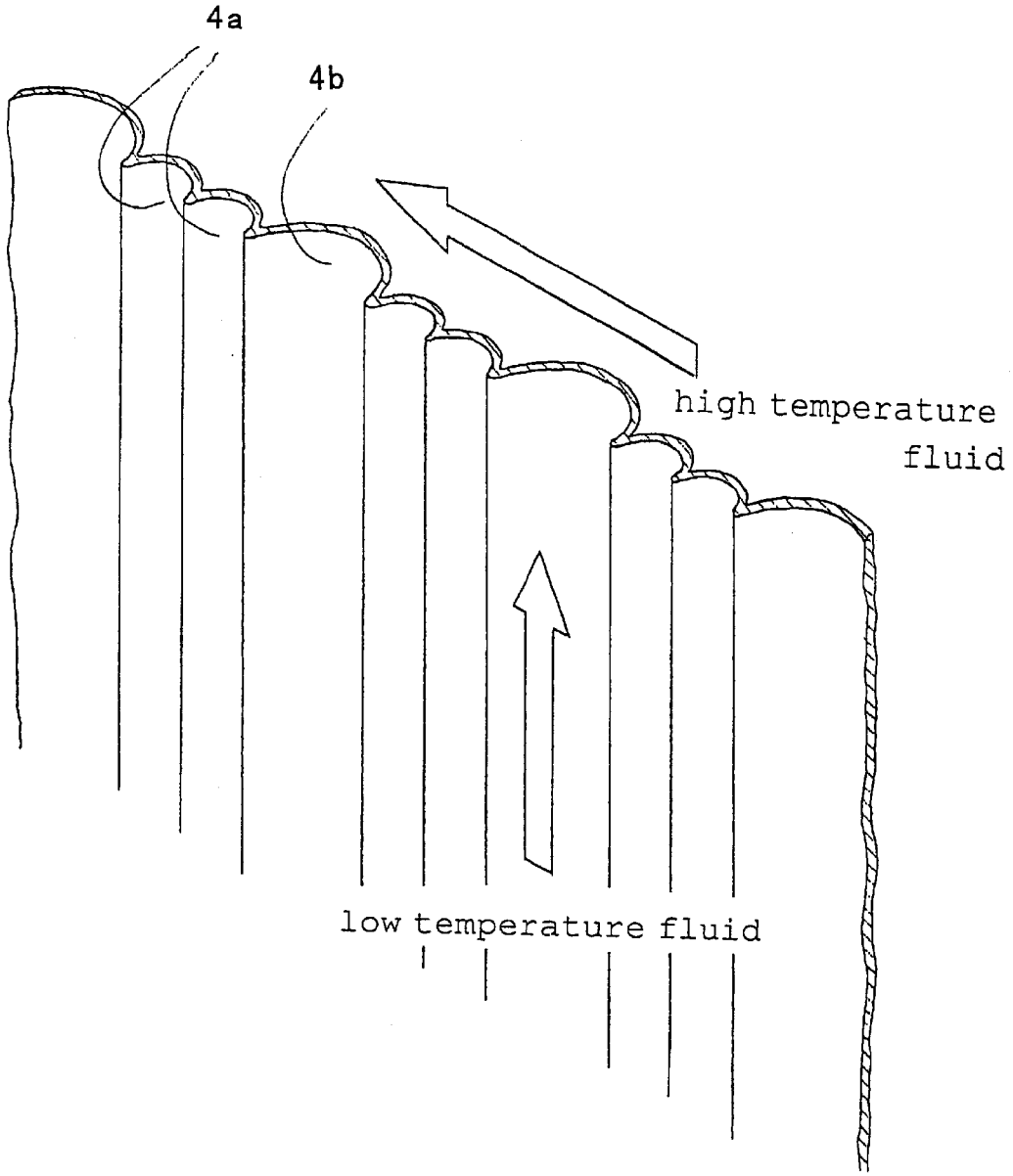
FIG. 3 is a perspective view of the essential part of the heat transferring face of the evaporator of the embodiment of the present invention, which has a sectioned portion.
Figure 4:
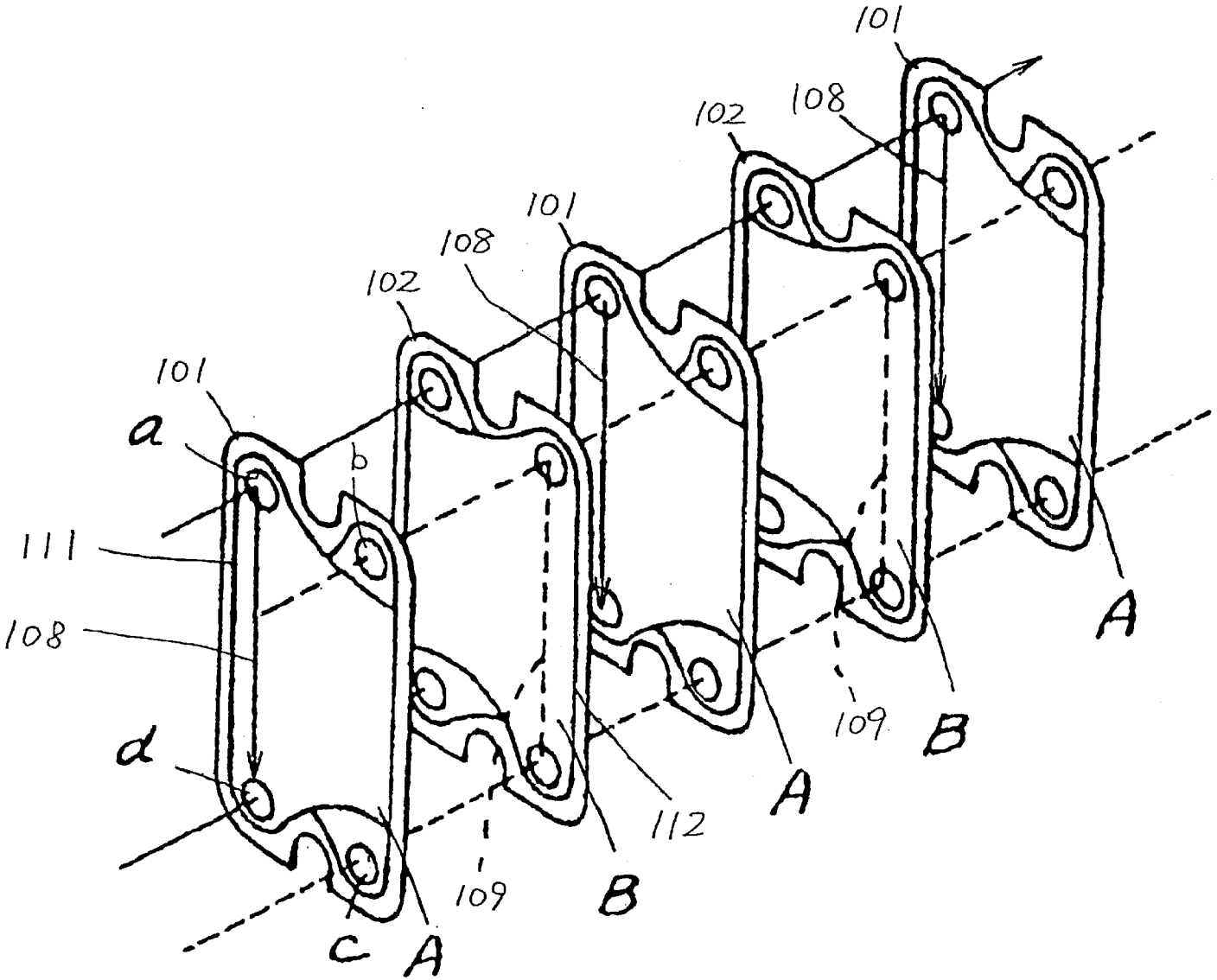
Fig. 4 (Prior Art)
FIG. 4 is an exploded perspective view of the essential part of the conventional evaporator.
Figure 5:
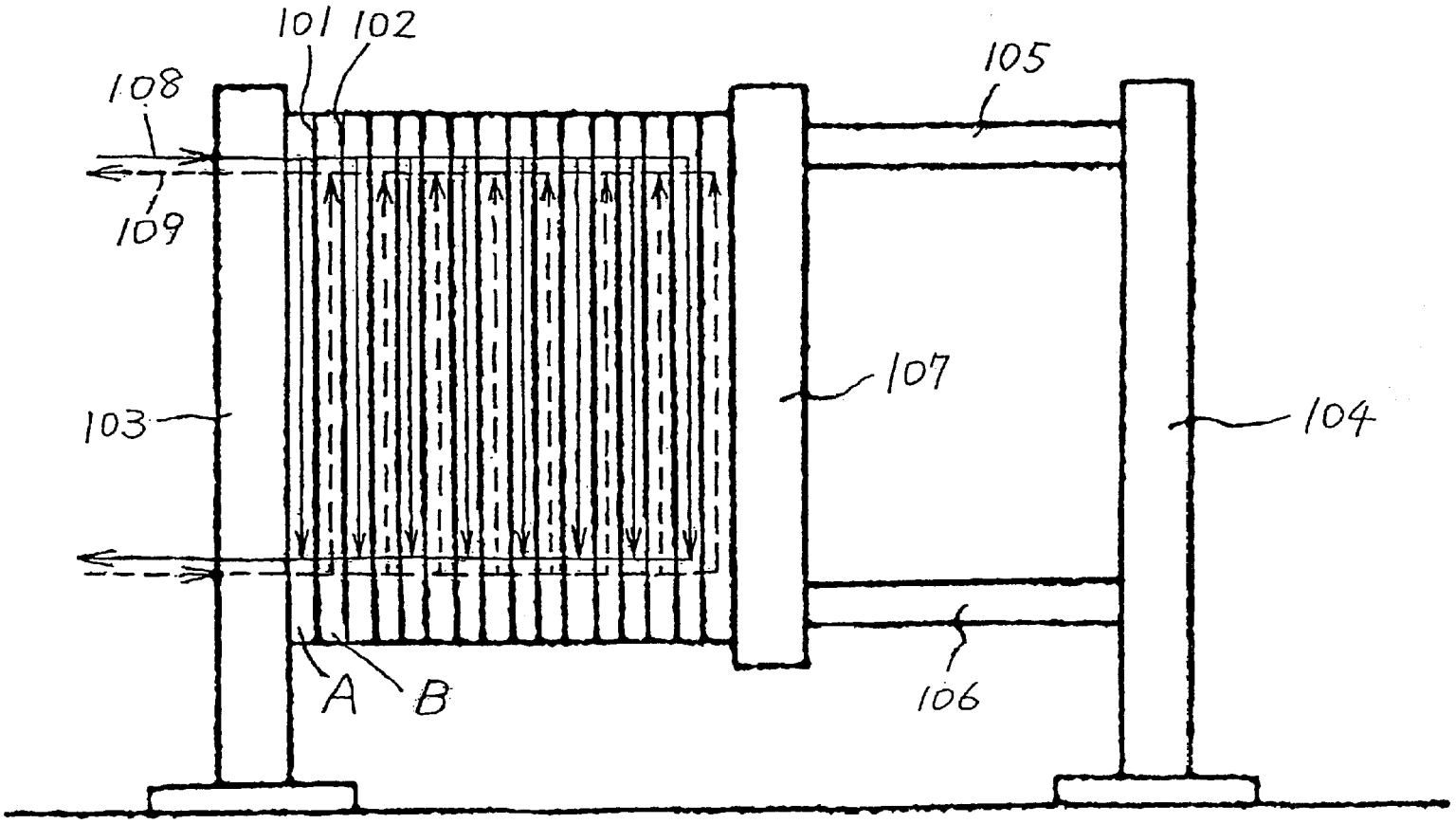
Fig. 5 (Prior Art)
FIG. 5 is a schematic descriptive view of the conventional evaporator in its assembling state.

As shown in FIGS. 1 to 3, the evaporator of the embodiment of the present invention is composed of a metallic shell 10 having a box-shape and of plural pairs of heat transferring faces 1, which pairs are arranged in parallel with each other in the shell 10. The two heat transferring faces 1, 1 forming each of the pairs thereof are formed of a metallic rectangular shaped material and are in parallel with each other so that the low temperature fluid can pass between the opposing surfaces of the two heat transferring faces 1, 1. The two heat transferring faces 1, 1 are joined to each other on their opposite side edges to form a tubular body. The upper and lower openings of the tubular body serve as the outlet and the inlet for the low temperature fluid, respectively, so that the low temperature fluid can flow from the lower portion of the tubular body to the upper portion thereof. The high temperature fluid flow between the shell 10 and the tubular bodies in the direction perpendicular to the flowing direction of the low temperature fluid. The side surfaces of the shell 10 surrounding the heat transferring faces 1 have a supply port 10*a* and a discharge port 10*b* for the high temperature fluid, respectively, which are formed on the positions corresponding to the intermediate portions of the heat transferring faces 1 in the vertical direction thereof. The upper and lower surfaces of the shell 10 have an outlet port 10*c* and an inlet port 10*d* for the low temperature fluid, which communicate with the upper and lower openings of the tubular bodies.

The heat transferring face 1 is divided into four local heat transferring zones by three parallel boundary lines. The four local heat transferring zones have prescribed patterns of irregularity, which are different from each other. Each of the prescribed patterns of irregularity is formed by opposite surfaces of the heat transferring face 1, which have a common concavo-convex shape to each other and an inverse relationship to each other in concavo-convexities that appears on the opposite surfaces of the heat transferring face 1, which locate on the high and low temperature fluids sides, respectively. Each of the patterns of irregularity has functions of improving the strength of the heat transferring face 1, imparting resistance to the flow of the fluid in the respective local heat transferring zone and guiding the fluid in the prescribed direction. The number of the local heat transferring zones arranged in the vertical direction of the heat transferring face 1 is not limited to four and the local heat transferring zones in the prescribed number other than four may be formed in accordance with the vertical distance of the heat transferring face 1.

Of the local heat transferring zones of the heat transferring face 1, the central zone 4, which locates in front of the supply port 10*a* of the shell 10 and in which zone the high temperature fluid has the maximum flowing velocity, has the concavo-convexity of the pattern of irregularity. Such a pattern of irregularity is formed in a shape of elongated projections or grooves that extend in the flowing direction of the low temperature fluid and is formed in a concavo-convex shape having a wavy cross section having a prescribed pitch, which extends in the flowing direction of the high temperature fluid. The concavo-convexity of the pattern of irregularity is formed by a repetition of combination of (1) two grooves 4*a* having the width of about 10 mm (viewed from the low temperature fluid side) by which the maximum coefficient of heat transfer (i.e., the maximum boiling heat transfer coefficient) relative to the low temperature fluid can be provided under the conditions that sea water is used as the high temperature fluid and ammonia or a mixture of ammonia and water is used as the low temperature fluid and (2) a groove 4*b* having the width of about 20 mm (viewed from the low temperature fluid side) by which the maximum coefficient of heat transfer (i.e., the maximum convective heat transfer coefficient) from the high temperature fluid can be provided under the same conditions (see FIG. 3). The central local heat transferring zone 4 has a porous layer (not shown), which is formed in a prescribed area (which is indicated by a reference symbol "p" in FIG. 2) on the intermediate portion in the flowing direction of the high temperature fluid of the surface of the low temperature fluid side of the heat transferring face 1 by a metal spraying method or the like. The porous layer has a thickness and a roughness, which can be adjusted appropriately in accordance with the kind of low temperature fluid to be used.

The two zones 3, 5, which are adjacent to the above-mentioned central zone 4, have the pattern of irregularity that is symmetrical relative to the bisector of the heat transferring face, which is in parallel with the flowing direction of the low temperature fluid. The pattern of irregularity of the above-mentioned two zones 3, 5 is formed in a shape of elongated projections or grooves that extend in the oblique direction to the flowing direction of the low temperature fluid and is formed in a concavo-convex shape having a wavy cross section having the prescribed pitch, which extend in the perpendicular direction to the above-mentioned oblique direction. The pattern of irregularity of the above-mentioned two zones 3, 5, which extends in the oblique direction, causes a smaller resistance to the flow of the high temperature fluid than that provided by the pattern of irregularity of the central zone 4.

The lowermost zone 2 of the heat transferring face 1 locates on the inlet side of the low temperature fluid. The lowermost zone 2 is formed in a shape of elongated projections or grooves that extend in the flowing direction of the low temperature fluid and is formed in a concavo-convex shape having a wavy cross section having the prescribed pitch, which extend in the flowing direction of the high temperature fluid. The pattern of irregularity of the lower most zone 2, in which the elongated projections or the grooves extend in the flowing direction of the low temperature fluid, causes a small resistance to the flow of the low temperature fluid.

Connection members (not shown), each of which is formed of a plate-shaped material having a prescribed width, surround the heat transferring faces 1. The connection members connect the two opposing heat transferring faces 1, 1 with each other and form the side faces of the tubular body so that the two opposing heat transferring faces 1, 1 can be spaced in parallel with each other by a prescribed distance. There is adopted the normal structure that the connection members have their smooth surfaces so as to reduce resistance to the flows of the fluids flowing inside and outside the tubular body, respectively. There may be adopted the specific structure that the connection members have a pattern of irregularity, which is obtained by arranging plural sets of concavo-convex shape at prescribed intervals so that the concavity appears on the high temperature fluid side and the convexity appears on the low temperature fluid side. Such a specific structure improves remarkably the supporting strength of the heat transferring face 1 relative to the pressure applied from the high temperature fluid.

Now, description will be given below of a heat exchange function of the evaporator having the above-described construction.

The low temperature fluid in a liquid phase is supplied upward to the lower portion of the tubular body having the two heat transferring faces 1, 1 through the inlet port 10*d* of the shell 10 under a prescribed pressure so that the low temperature fluid can flow between the heat transferring faces 1, 1 forming the inner surfaces of the tubular body. The high temperature fluid is continuously supplied from the supply port 10*a* of the shell 10, while discharging it from the discharge port 10*b*. The high temperature fluid flows outside the heat transferring faces 1, 1 forming the outer surfaces of the tubular body in the perpendicular direction to the flowing direction of the low temperature fluid, thus making a heat exchange through the heat transferring faces 1, 1.

The high temperature fluid flowing in front of the supply port 10*a* of the shell has the maximum flowing velocity in the velocity distribution thereof. The flowing velocity of the high temperature becomes smaller according as a distance between the supply port 10*a* and a place near which the high temperature fluid flows becomes longer. If the heat transferring face 1 has no pattern of irregularity, the high temperature fluid comes into contact with the zones of the heat transferring face 1 in a flow rate according to the velocity distribution of the high temperature fluid. However, the heat transferring face 1 has the patterns of irregularity formed in the local heat transferring zones so as to obtain a large resistance to the flow of the high temperature fluid in the central zone 4 locating in front of the supply port, in which the high temperature fluid has the maximum flowing velocity, on the one hand, and a small resistance to the flow of the high temperature fluid in the other zones 3, 5, in which the high temperature fluid has the smaller flowing velocity, on the other hand. Consequently, the high temperature fluid supplied to the heat transferring face 1 flows in a prescribed amount from the zone 4 having the large resistance to the zones 3, 5 having the small resistance so as to provide a uniform distribution of the high temperature fluid relative to all the zones of the heat transferring face 1, which serve as a member for boiling the low temperature fluid (see FIG. 2). It is therefor possible to obtain a uniform heat transfer from the high temperature fluid over the entire surface of the heat transferring face 1, thus making a sufficient heat transfer to the low temperature fluid.

The low temperature fluid comes into contact with the entirety of the lowermost zone 2 of the heat transferring face 1, between the heat transferring faces 1, 1 forming the inside surfaces of the tubular body. The low temperature fluid receives heat from the high temperature fluid flowing outside the heat transferring face 1 therethrough. The low temperature fluid is consequently heated and reaches the zone 3 locating above the lowermost zone 2. In the above-mentioned zone 3, the low temperature fluid is boiled on the heat transferring face 1 through the heat transfer from the high temperature fluid so as to generate bubbles. In the central zone 4 locating above the zone 3, the low temperature fluid is boiled at the intermediate porous portion of the zone 4, to generate a large amount of fine bubbles. The thus generated fine bubbles immediately move upward together with the bubbles, which are generated in the zone 3, along the pattern of irregularity extending vertically, without hindrance of the contact between the heat transferring face 1 and the low temperature fluid, which is in a liquid phase. In the zone 5 locating above the zone 4, the low temperature fluid including the bubbles is heated further to cause the complete evaporation of the liquid component. Accordingly, vapor moves upward to remove from the low temperature fluid in a liquid phase and becomes the low temperature fluid in a gaseous phase. The low temperature fluid in the gaseous phase passes between the two heat transferring faces 1, 1 to reach the upper opening and is discharged outside from the outlet port 10*c* of the shell 10.

In the evaporator of the embodiment of the present invention, the heat transferring faces 1 are disposed in the shell 10, each of the heat transferring faces 1 is provided with the four zones having the prescribed patterns of irregularity, which are different from each other, and the heat exchange is made through the heat transferring faces 1 by causing the low temperature fluid to flow between the heat transferring faces 1, 1, while causing the high temperature fluid to flow on the opposite side to the low temperature fluid relative to the heat transferring face 1 in a uniform flow rate over the entirety of the heat transferring face 1. It is therefore possible to obtain the maximum coefficient of heat transfer from the high temperature fluid over the entirety of the heat transferring face 1 and achieve the smooth flow of the low temperature fluid in liquid and gaseous phases, to make a sufficient heat transfer from the heat transferring face 1, thus improving remarkably the heat exchange efficiency. The formation of the prescribed patterns of irregularity on the heat transferring face 1 and the porous layer in the prescribed region on the surface of the low temperature fluid side of the heat transferring face 1 makes it possible to facilitate the generation of bubbles on the heat transferring face 1 to make effectively the phase change of the low temperature fluid, thus improving the evaporative power of the evaporation.

In the evaporator of the embodiment of the present invention, the concavo-convexity of the pattern of irregularity in the central zone 4 of the heat transferring face 1 is formed by a repetition of combination of the two grooves 4*a* having the width by which the maximum coefficient of heat transfer relative to the low temperature fluid can be provided, on the one hand, and the groove 4*b* having the width by which the maximum coefficient of heat transfer from the high temperature fluid can be provided. The pattern of irregularity is not limited only to such a structure. The arrangement may be altered by alternating the groove 4*a* having the small width and the groove 4*b* having the large width. The grooves having the same width may be arranged in parallel with each other. The values of the width of the grooves are not limited only to those mentioned above. When the high and low temperature fluids to be used are different in their kinds from each other, the grooves may have their appropriate widths in accordance with the kinds of the fluids.

In the evaporator of the embodiment of the present invention, the central zone 4 of the heat transferring face 1 has the pattern of irregularity, which is formed in the concavo-convex shape having the wavy cross section that is obtained by a repetition of semi-circular arches. There may be adopted the pattern of irregularity, which is formed in the concavo-convex shape having the wavy cross section that is obtained by a repetition of the V-shape, U-shape or the like. Such a pattern of irregularity causes the high temperature fluid to be stirred on the surface of the high temperature fluid side of the heat transferring face 1 to increase the contact efficiency, thus improving more remarkably the heat transfer efficiency from the high temperature fluid to the heat transferring face 1.

In the evaporator of the embodiment of the present invention, the pattern of irregularity of the two zones 3, 5 of the heat transferring face 1, which are adjacent to the central zone 4 is formed in the shape of elongated projections or grooves that extend in the oblique direction to the flowing direction of the low temperature fluid and is formed in the concavo-convex shape having the wavy cross section having the prescribed same pitch, which extend in the perpendicular direction to the above-mentioned oblique direction. The pattern of irregularity of the two zones 3, 5 of the heat transferring face 1 may be formed, as in the central zone 4, in the concavo-convex shape that is obtained by arranging elongated projections or grooves having a small width by which a maximum coefficient of heat transfer relative to the low temperature fluid can be provided, on the one hand, and elongated projections or grooves having a large width by which a maximum coefficient of heat transfer from the high temperature fluid can be provided, on the other hand, alone or in combination by a prescribed pitch. According such a structure, it is possible to obtain the maximum heat transfer efficiency from the high temperature fluid to the low temperature fluid in the whole heat transfer system, thus improving the heat exchange efficiency.

In the evaporator of the embodiment of the present invention, the shell 10 has the single outlet port 10*c* and the single inlet port 10*d*. The shell 10 is not limited to such a structure and the outlet port and the inlet port may be formed in plural number, respectively. According to such a structure, it is possible to uniformly supply the low temperature fluid into the tubular body forming the heat transferring faces 1, even when the evaporator has a large width in the horizontal direction due to the increased number of the heat transferring face and the expanded area thereof.

In the evaporator of the embodiment of the present invention, an ultrasonic vibrator may be provided in the supply passage for the low temperature fluid in the upstream side of the inlet port 10*d* of the shell to vibrate the low temperature fluid by means of an ultrasonic wave. According to such a ultrasonic vibrator, the ultrasonic wave generates fine bubbles in the low temperature fluid. When the low temperature fluid including the fine bubbles reaches the heat transferring face 1, the bubbles rise to the surface along the heat transferring face 1 so as to stir the low temperature fluid in a liquid phase, which flows on the lower portion of the heat transferring face 1. It is therefore possible to improve the contact efficiency between the low temperature fluid and the heat transferring face 1, thus improving the evaporation efficiency.

According to the present invention as described in detail, by providing the local heat transferring zones on the heat transferring face for the heat exchange, forming the prescribed patterns of irregularity, which are different from each other in the respective local heat transferring zones and imparting resistance corresponding to the flowing velocity of the high temperature fluid to the supplied high temperature fluid by the patterns of irregularity in the respective local heat transferring zones, it is possible to distribute uniformly the supplied high temperature fluid to each of the local heat transferring zones of the heat transferring face. Accordingly, it is possible to cause the high temperature fluid to flow over the entirety of the heat transferring face so as to obtain a uniform flow rate of the high temperature fluid on the respective local heat transferring zones, improve the contact efficiency of the high temperature fluid with the entirety of the heat transferring face and improve the heat transfer efficiency of the high temperature fluid to the low temperature fluid through the heat transferring face, although the high temperature fluid does not flow in a uniform state in the flowing direction of the low temperature fluid on the heat transferring face and the high temperature fluid cannot be supplied over the entire surface in a uniform flow rate in the conventional manner, due to the biased position for the supply of the high temperature fluid.

According to the present invention, it is possible to cause the high temperature fluid to flow more smoothly in the local heat transferring zone, which is adjacent to the other local heat transferring zone, in which the high temperature fluid has the maximum flowing velocity, rather than the above-mentioned other local heat transferring zone to obtain a uniform flow rate of the high temperature fluid over the entirety of the heat transferring face, by forming the pattern of irregularity of one of the local heat transferring zones, in which the high temperature fluid has the maximum flowing velocity, in a concavo-convex shape, which extends in the flowing direction of the high temperature fluid, so as to increase resistance to the flow of the high temperature fluid, on the one hand, and forming the pattern of irregularity of the other local heat transferring zone, which is adjacent to the above-mentioned one zone, in a concavo-convex shape, which extends in the oblique direction to the flowing direction of the low temperature fluid, so as to decrease resistance to the flow of the high temperature fluid. Consequently, it is possible to improve the contact efficiency of the entirety of the heat transferring face with the high temperature fluid, improve the heat transfer efficiency of the high temperature fluid to the heat transferring face and facilitate the evaporation efficiency of the low temperature fluid.

According to the present invention, it is possible to obtain the maximum coefficient of heat transfer from the high temperature fluid to the low temperature fluid so as to facilitate the evaporation efficiency thereof, by forming the concavo-convex shape in a prescribed region of the heat transferring face, which shape is obtained by arranging the elongated projections or the grooves having a size by which the maximum coefficient of heat transfer from the high temperature fluid can be provided, on the one hand, and the elongated projections or the grooves having a size by which the maximum coefficient of heat transfer relative to the low temperature fluid can be provided, on the other hand, alone or in combination by a prescribed pitch, and by maintaining an improved condition on the heat transfer property of the respective fluids and the heat transferring face.

According to the present invention, it is possible to ensure the large heat transferring area utilizing the convavo-convex shape and facilitate the improved contact of the high temperature fluid with the local heat transferring zone of the low temperature fluid flowing side of the heat transferring face to cause a proper heat transfer by forming the pattern of irregularity of the local heat transferring zone locating nearest to the inlet of the low temperature fluid into a prescribed shape, a longitudinal direction of which is identical to the flowing direction of the low temperature fluid so that the low temperature fluid can easily flow on the heat transferring face. In addition, it is possible to reduce the flow resistance of the low temperature fluid to cause the low temperature fluid to flow smoothly between the heat transferring faces for contact with the heat transferring face. As a result, the improved heat transfer from the heat transferring face to the low temperature fluid can be obtained, thus causing efficiently the boiling and evaporation of the low temperature fluid.

According to the present invention, it is possible to make bubbles as fine as possible, which are generated in the low temperature fluid by heat, and discharge smoothly them upward by forming the porous portion on the heat transferring face, which locates in the middle portion of its surface of the low temperature fluid side, to increase the number of bubble generation cores in the low temperature fluid, which comes into contact with the heat transferring face to be heated, and to facilitate removal of the bubble generation cores, which have grown to a prescribed size, from the heat transferring face. As a result, it is possible to ensure the large contact area of the low temperature fluid in the liquid phase with the heat transferring face, thus causing efficiently evaporation of the low temperature fluid.

According to the present invention, it is possible to use the heat transferring face in the normal state as well as in the inside-out turning state so that the heat transferring faces having the same shape can form the opposing members, thus reducing the cost of the evaporator itself, by making the pattern of irregularity of each of the local heat transferring zones of the heat transferring face symmetrical relative to the bisector of the heat transferring face so as to permit to reverse the flowing direction of the high temperature fluid without causing any change in the heat transfer condition.

What is claimed is:

1. An evaporator comprising:

at least one heat transferring face formed of a plate-shaped material, a change of a phase of a low temperature fluid from a liquid phase to a gaseous phase being made by causing a high temperature fluid and the low temperature to flow on opposite surface sides of said heat transferring face, respectively, so that flowing directions of said high and low temperature fluids are perpendicular to each other, to make a heat exchange, wherein: said heat transferring face comprises a plurality of local heat transferring zones, which are arranged in the flowing direction of said low temperature fluid, said local heat transferring zones having prescribed patterns of irregularity, which are different from each other, and each said prescribed patterns of irregularity being formed by opposite surfaces of said heat transferring face, which have a common concavo-convex shape to each other having a wavy cross section, and an inverse relationship to each other in concavo-convexities that appear on the opposite surfaces of said heat transferring face, which locate on the high and low temperature fluids sides, respectively; and the concavo-convexity of the pattern of irregularity in each of said local heat transferring zones has a shape, which permits to impart a large resistance force to said high temperature fluid in a place where the high temperature has a high flowing velocity and a small resistance force thereto in another place where the high temperature fluid can flow along the heat transferring face in a uniform distribution state in each of the local heat transferring zones.

2. The evaporator as claimed in claim 1, wherein:

the pattern of irregularity of one of the local heat transferring zones of said heat transferring face, in which the high temperature fluid has a maximum flowing velocity, is formed in a shape of elongated projections or grooves that extend in the flowing direction of the low temperature fluid and is formed in a concavo-convex shape having a wavy cross section having a prescribed pitch, which extends in the flowing direction of the high temperature fluid; and the pattern of irregularity of another of the local heat transferring zones, which is adjacent to said one of them, is formed in a shape of elongated projections or grooves that extend in a oblique direction to the flowing direction of the low temperature fluid by a prescribed angle and is formed in a concavo-convex shape having a wavy cross section having a prescribed pitch, which extend in a perpendicular direction to said oblique direction.

3. The evaporator as claimed in claim 2, wherein:

the pattern of irregularity of said heat transferring face, which is formed in the concavo-convex shape having the wavy cross section, is obtained by arranging the elongated projections or the grooves having a size by which a maximum coefficient of heat transfer from the high temperature fluid can be provided, on the one hand, and the elongated projections or the grooves having a size by which a maximum coefficient of heat transfer relative to the low temperature fluid can be provided, on the other hand, alone or in combination by a prescribed pitch.

4. The evaporator as claimed in any one of claims 1 to 3, wherein:

the pattern of irregularity of one of the local heat transferring zones of said heat transferring face, which one locates nearest to an inlet of the low temperature fluid, is formed in a shape of elongated projections or grooves that extend in the flowing direction of the low temperature fluid and is formed in a concavo-convex shape having a wavy cross section having a prescribed pitch, which extends in the flowing direction of the high temperature fluid.

5. The evaporator as claimed in any one of claims 1 to 4, wherein, said heat transferring face is porous in a prescribed region, which is located in a middle portion of its surface of the low temperature fluid side in the flowing direction of the high temperature fluid, in one of the local heat transferring zones, in which the high temperature fluid has a maximum flowing velocity.

6. The evaporator as claimed in any one of claims 1 to 5, wherein:

said heat transferring face is formed of the plate-shaped material having a rectangular or square shape, sides of which coincide with the flowing directions of the high and low temperature fluids, respectively; and the pattern of irregularity of each of the local heat transferring zones of said heat transferring face is symmetrical relative to a bisector of the heat transferring face, which is in parallel with the flowing direction of the low temperature fluid.

* * * * *